US006682466B1

(12) United States Patent
Ellis

(10) Patent No.: US 6,682,466 B1
(45) Date of Patent: Jan. 27, 2004

(54) MOTION TRANSLATION ARRANGEMENT FOR LIMITING THE RATE OF LEVER ARM CONVERGENCE IN AN EXERCISE MACHINE

(75) Inventor: Patrick D. Ellis, Milwaukee, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 0 days.

(21) Appl. No.: 10/315,520

(22) Filed: Dec. 10, 2002

(51) Int. Cl.[7] ..... A63B 26/00
(52) U.S. Cl. ..... 482/142; 482/907; 482/908
(58) Field of Search ..... 482/142, 907, 482/908, 148

(56) References Cited

U.S. PATENT DOCUMENTS

| | | | |
|---|---|---|---|
| 5,044,632 | A | 9/1991 | Jones |
| 5,273,505 | A | 12/1993 | Jones |
| 5,554,089 | A | 9/1996 | Jones |
| RE35,470 | E | 3/1997 | Jones |
| 5,769,757 | A | 6/1998 | Fulks |
| 5,810,701 | A | 9/1998 | Ellis et al. |
| 6,071,216 | A | 6/2000 | Giannelli et al. |
| 6,142,917 | A | 11/2000 | Giannelli et al. |
| 6,152,864 | A | 11/2000 | Giannelli et al. |
| 6,254,516 | B1 | 7/2001 | Giannelli et al. |
| 6,394,937 | B1 | 5/2002 | Voris |
| 2001/0001776 | A1 | 5/2001 | Jones |
| 2002/0052268 | A1 | 5/2002 | Morcillo-Quintero et al. |
| 2002/0107117 | A1 | 8/2002 | Carter |

*Primary Examiner*—Nicholas D. Lucchesi
*Assistant Examiner*—L Amerson
(74) *Attorney, Agent, or Firm*—Andrus, Sceales, Starke & Sawall, LLP

(57) ABSTRACT

A shoulder press machine is provided having a seat, a backrest and a fixed framework at the top of which a carriage is mounted. The carriage has a pair of downwardly and forwardly extending, diverging lever arms which are tied together and moved upwardly and downwardly along a horizontal pivot axis mounted to the framework behind the backrest. As the lever arms are moved together upwardly, they are simultaneously swung inwardly about a first pair of parallel, pivot axes, the swinging motion being transferred via a pair of connector linkages to pivot the lever arms about a second pair of pivot axes defined by a pair of frame knuckles at the back end of the frame. As a result of these linkages, a shoulder press machine is provided in which the lever arms are moved in inwardly curved, converging planes from a lowermost location to an uppermost location in such a way that the rate of convergence decreases as the lever arms are raised to a point of substantially no convergence. The inventive machine thus provides for an optimal range of motion for exercisers regardless of the exerciser's arm length.

16 Claims, 8 Drawing Sheets

MOTION TRANSLATION ARRANGEMENT FOR LIMITING THE RATE OF LEVER ARM CONVERGENCE IN AN EXERCISE MACHINE

FIELD OF THE INVENTION

The invention relates broadly to an exercise machine and, more particularly, pertains to an improved and simplified motion translation arrangement which maximizes the muscular benefits of an exercise motion while minimizing stress to the joints and skeletal structure associated with the muscle group being exercised.

BACKGROUND OF THE INVENTION

As is well known, many types of exercise machines have been designed to develop or rehabilitate specific muscle groups of the human body. Most of these machines have one or more operating levers or other instruments to be engaged by one while performing desired exercises. The operating levers are generally disposed in the machine to follow a prescribed exercise path. The exerciser is therefore induced to move his or her body according to the particular structure of the machine.

Machines of this variety offer a certain amount of exercise control in direct contrast to the use of free weights still preferred by many exercisers. Exercise movements with free weights are not constrained to follow predetermined planes of motion or prescribed angles. On the other hand, besides being generally safer then free weights, exercise machines address the various "sticking points" experienced in motions with free weights and have attempted to match a resistance variation throughout an entire range of motion with the natural strength curve of a particular muscle group. Although this controlled movement is generally desirable in order to isolate or associate an exercise with particular muscles or muscle groups, the mechanical design of the prior art exercise machines often defines a motion which is incompatible with the musculoskeletal makeup of the body.

This is particularly true in exercising muscles of the upper torso which commonly involve the shoulder, wrist and elbow joints. Because the shoulder joint, in particular, is subject to flexion, extension, abduction, adduction, rotation and combinations of these movements, it is extremely important that the use of the exercise machine will not cause the shoulder joint to be subjected to unnatural movements over the range of movement of the joint.

U.S. Pat. No. 5,810,701 issued to Ellis et al. on Sep. 22, 1998 and assigned to the assignee of the current application specifically addresses the shortcomings of the prior art discussed above. In the Ellis et al. patent, there is disclosed a motion translation arrangement in a shoulder press machine having a seat, a backrest and fixed framework at the top of which a carriage is mounted. The carriage has a pair of downwardly and forwardly extending, diverging lever arms which are tied together and moved upwardly and downwardly along a major horizontal axis mounted to the framework behind the backrest and a minor horizontal axis offset behind and parallel to the major horizontal axis. As the lever arms are moved together upwardly, they are simultaneously swung inwardly about a pair of parallel, angular pivot axes, the swinging motion being transferred via a pair of transfer linkages to pivot the pair of sleeves about the minor horizontal axis. As a result of these linkages, a shoulder press machine is provided in which an exerciser's hands rotate or supinate naturally through approximately 20 degrees to 30 degrees as the lever arms are pushed upwardly progressively through converging, convex arcs. The inventive machine much more easily accommodates the natural musculoskeletal makeup of the human body without stress to the shoulder joints.

While the Ellis et al. machine performs generally satisfactorily in most cases, it has been discovered that the machine does not always provide a full range of motion, particularly for users with long arm lengths. That is, a user with long arm lengths can be prevented from full extension of his/her arms because of the meeting of the lever arms as the lever arms travel through their progressively converging, convex arcs and approach their uppermost position. Accordingly, it would be desirable to modify the Ellis et al. motion translation arrangement so as to improve the range of motion of the exercise for users regardless of their arm lengths while still maintaining a natural motion compatible with the musculoskeletal makeup of the body. It is also desirable to provide an exercise machine utilizing lever arms with handles moveable through limited converging, concave arcs in such a manner that the rate of convergence of the lever arms decreases and reaches substantially no convergence as the lever arms are raised towards an uppermost position.

SUMMARY OF THE INVENTION

It is one object of the present invention to provide an improved method and apparatus for the exercise of an upper torso of a person.

It is a further object of the present invention to provide a carriage arrangement for defining an exercise path which will enable full resistance over an entire range of exercise motion with a minimum of stress on the shoulder, elbow and wrist joints.

It is an additional object of the present invention to provide an exercise machine which particularly accommodates, users with long as well as short arm lengths.

It is also an object of the present invention to provide a shoulder press machine which effectively and safely exercises the deltoids, pectoral muscles and triceps.

Still another object of the present invention is to provide a low lat pull machine employing a motion translation arrangement as applied to the shoulder press machine.

Yet another object of the present invention is to provide an exercise machine which offers a degree of supination or pronation.

In one aspect of the invention, a shoulder press machine having a variable resistance provided therein includes a frame and a seat mounted to the frame. A motion translation arrangement is pivotally mounted to the frame about at least one horizontal axis and defines a first pair of spaced, parallel pivot axes lying perpendicular to the horizontal pivot axis. A pair of lever arms is movable against the variable resistance, the lever arms having rearward portions pivotally connected to the carriage about the first pair of pivot axes, rearward ends rotatably mounted about a second pair of pivot axes lying perpendicular to and below the horizontal pivot axis, and downwardly extending, outwardly diverging forward ends having inwardly extending handles. The motion translation arrangement is constructed and arranged to provide a shoulder exercise motion for an exerciser occupied in the seat wherein the handles and lever arms are moved in curved, converging planes from a lowermost location to an uppermost location substantially upwardly, rearwardly and inwardly from the lowermost location. The lever arms are moved in such a way that the rate of convergence decreases as the lever arms are raised to a point of substantially no convergence so as to provide an optimum range of motion for users regardless of their arm length. The variable resistance is preferably a weight plate removably connected to each of the lever arms. The second pair of pivot axes are defined by a pair of machine frame knuckles fixedly connected to a back of the frame. The second pair of pivot axes are located below the rearward ends of the lever arms.

In another aspect of the invention, an exercise machine has a frame and a seat adjustably mounted on the frame. A carriage is pivotally mounted to the frame about a horizontal pivot axis, the carriage defining a first pair of spaced, parallel pivot axes lying perpendicular to the horizontal pivot axis. A pair of curvilinear lever arms is provided, each having one rearward portion pivotally connected to the carriage at one of the first pair of pivot axes, a rearward end rotatably mounted about one of a second pair of pivot axes lying below the horizontal pivot axis and a forward end provided with a handle. Structure is provided for resisting movement of the lever arms. With this construction, movement of the lever arms and the carriage against the resisting structure and about the horizontal pivot axis will be translated into lateral motion of the lever arms about the first and second pair of pivot axes such that each of the handles will move in converging, concave arcs from a first location spaced laterally from a vertical plane bisecting the exercise machine to a second location substantially upwardly, rearwardly and inwardly from the first location, the lever arms being moved in such a, way that the rate of convergence decreases as the lever arms are raised to a point of substantially no convergence so as to provide an optimal range of motion for exercisers regardless of their arm length. The seat is adapted to support an exerciser in a declined seated position straddling the vertical plane. Each of the lever arms is provided with at least one laterally extending spindle for supporting at least one weight plate. An initial starting position for each lever arm is about 20° from horizontal. The rearward end of each lever arm includes an arm knuckle moveably joined by a connector link to a frame knuckle mounted at a back end of the frame.

In yet another aspect of the invention, an exercise machine has a frame, a seat mounted on the frame and a pair of lever arms pivotally mounted relative to the frame and having handles mounted thereon. The invention is improved by a carriage pivotally mounted to the frame about a horizontal pivot axis. The carriage defines a first pair of parallel, spaced pivot axes lying perpendicular to the horizontal pivot axis and has a pair of transfer linkages. Each linkage is swingably connected at one end to one of the lever arms and pivotally connected at another end to the frame about a second pair of pivot axes located below the horizontal pivot axis. Movement of the lever arms and the carriage about the horizontal pivot axis and the first pair of pivot axes will be translated into lateral motion of the lever arms about the second pair of pivot axes such that each lever arm moves in a concave path from a first location to a second location in such a manner that the handles are prevented from contacting each other as the lever arms approach the second location. The exercise machine may be in the form of a shoulder press machine or a low lat pull machine. Each transfer linkage is comprised of an arm knuckle attached to a rearward end of one of the lever arms, a frame knuckle joined to a back end of the frame and a connector link joining the arm knuckle and the frame knuckle. The horizontal pivot axis passes through a shaft rotatably supported in a set of primary pillow block bearings mounted on the frame. Each of the first pair of pivot axes passes through a shaft rotatably supported in a set of secondary pillow block bearings mounted on the carriage.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention.

In the drawings.

DETAILED DESCRIPTION OF THE INVENTION

Figure 1:
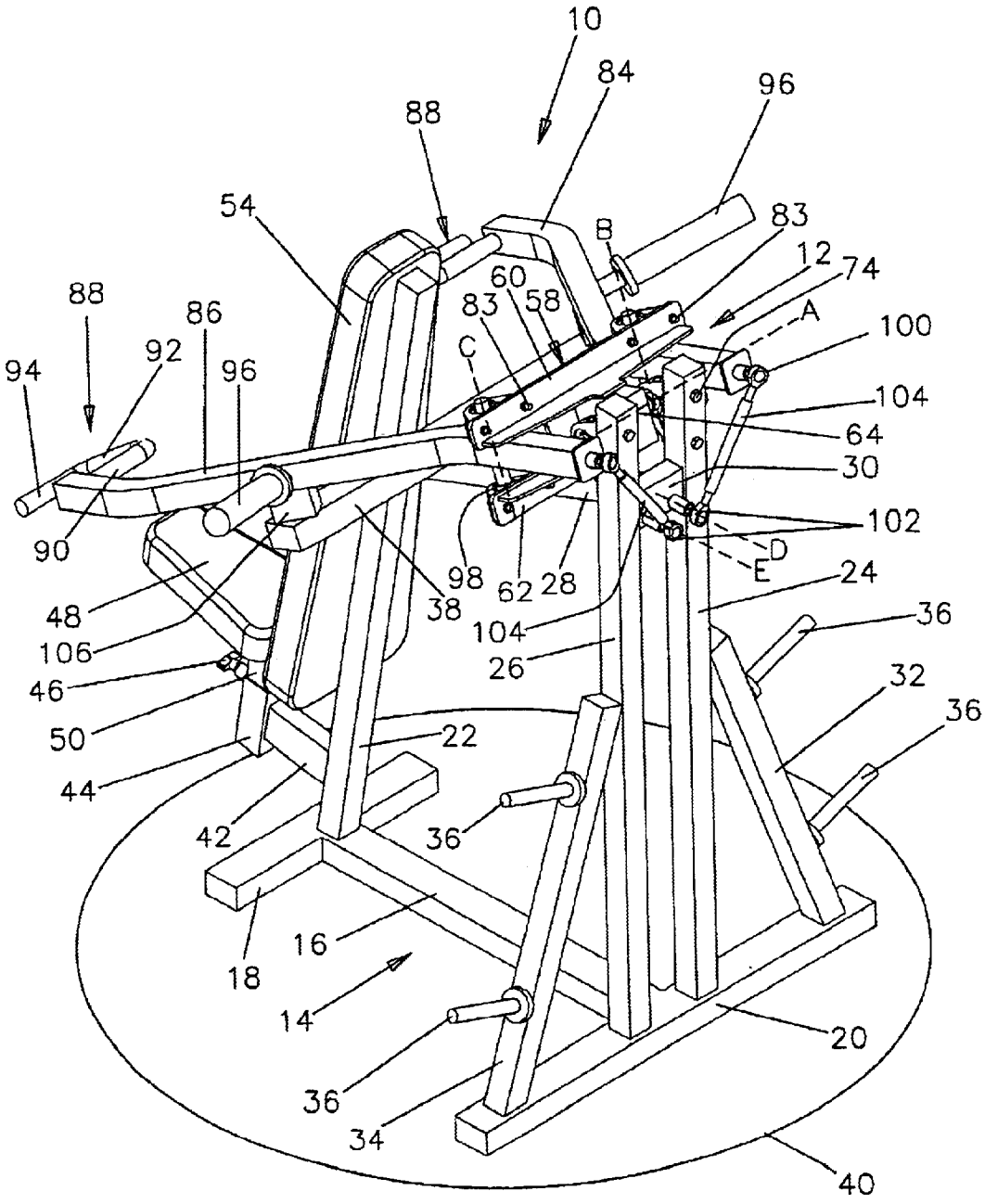
FIG. 1 is a rear perspective view of a plate loaded shoulder press machine embodying the invention, the machine being equipped with a pair of lever arms in a lowermost position.
Figure 2:
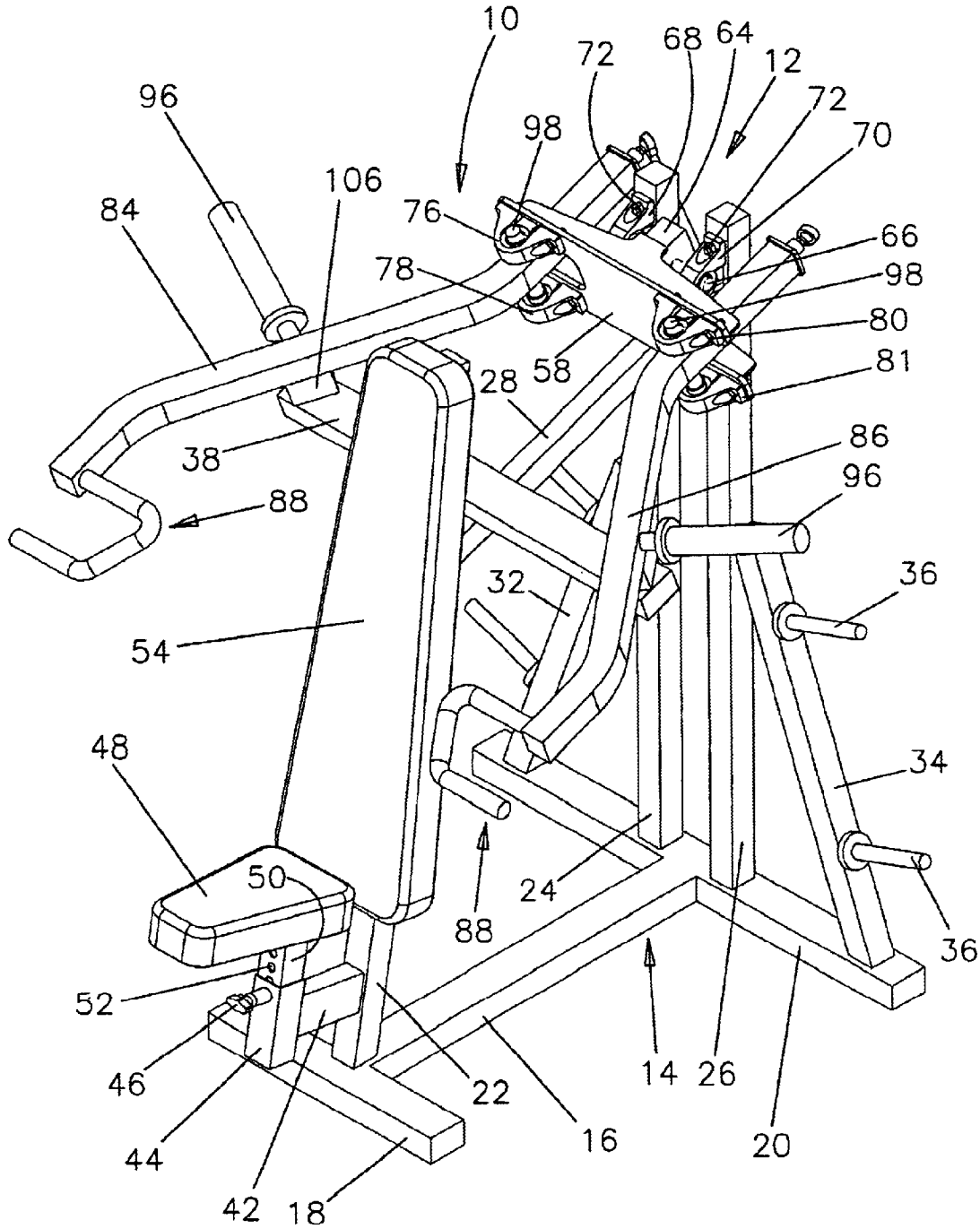
FIG. 2 is a front perspective view of the machine shown in FIG. 1.

FIGS. 1 through 7 illustrate a shoulder press machine 10 provided with a motion translation arrangement 12 embodying the present invention. The motion translation arrangement 12 is improved and simplified relative to the aforementioned U.S. Pat. No. 5,810,701. The machine 10 includes a frame 14 constructed of a series of straight sections of heavy duty, tubular steel which are welded together. In particular, the frame 14 comprises a base member 16 connected to a front transverse member 18 and a rear transverse member 20 which lends stability to the apparatus. In the preferred embodiment, the lengths of the members 16, 18 and 20 are chosen to establish a reasonably sized foot print which reflects the space efficiency of the machine 10. A front leg 22 rises upwardly and rearwardly from the center of front transverse member 18, and a pair of spaced, parallel rear uprights 24, 26 extend substantially vertically and perpendicularly from the rear transverse member 20. An angular brace 28 connects the front leg 22 with a short cross member 30 (FIGS. 1 and 4), joining the uprights 24, 26.)

On each side of the uprights 24, 26 is a downwardly and outwardly extending gusset 32, 34, respectively, which is welded between a respective upright 24, 26 and one end of the rear transverse member 20. Each of the gussets 32, 34 is provided with a pair of outwardly projecting, cylindrical spindles 36 which serve to support removable weight plates (not shown). Connected across the angular brace 28 behind the front leg 22 and generally parallel to the front and rear transverse members 18, 20 is a lever arm support member 38. The frame 14 can be supported at its corners by welded bottom plates 39 (FIGS. 8 and 9) which may be apertured to facilitate the securement of the machine 10 to a supporting surface 40, such as a gym or home floor.

The bottom portion of the front leg 22 has a forwardly extending tongue 42 having a hollow tubular member 44 connected substantially perpendicularly thereto. The tubular member 44 carries a spring set, positioning pin 46 which provides for the upward and downward adjustability of a seat 48 having a downwardly projecting tubular support post 50. Appropriately aligned openings 52 (FIG. 2) formed in the tubular member 50 receive the positioning pin 46. The seat 48 is adapted to be positioned at various heights so as to provide a comfortable starting position for an exerciser and allow a range of motion for a user of varying stature. A backrest 54 is joined to the angularly disposed front leg 22 above the seat 48 so that during exercise, one occupies a sedentary position in a partially reclined orientation. The seat 48 and backrest 54 combine to create a support system for ensuring the comfort of the user during exercising. Typically, the seat 48 is declined rearwardly at an angle of about 10 degrees from horizontal, while the backrest 54 is disposed at an angle of about 10 degrees from vertical. The seat 48 and the backrest 54 are bisected by a vertical plane 56, FIG. 6, which essentially divides the machine 10 into two symmetrical halves.

The motion translation arrangement 12 provides that an exerciser may move his or her hands from a first position spaced laterally from the vertical plane 56 to a second location (shown in phantom lines of FIG. 6) substantially upwardly, rearwardly and inwardly from the first location. During the course of this motion, an exerciser's hands are slightly rotated or supinated, so that the machine 10 more easily accommodates the natural muscoloskeletal makeup of the body without stress to the shoulder, elbow or wrist joints.

Further, and in accordance with the invention, the motion translation arrangement 12 provides a mechanism for moving an exerciser's hands in inwardly, converging planes from a lowermost location to an uppermost location. The motion translation arrangement permits the handles to be moved in such a way that the rate of convergence decreases as the hands are raised to a point of substantially no convergence to provide an optimal range of motion for exercisers regardless of their arm length.

Figure 4:
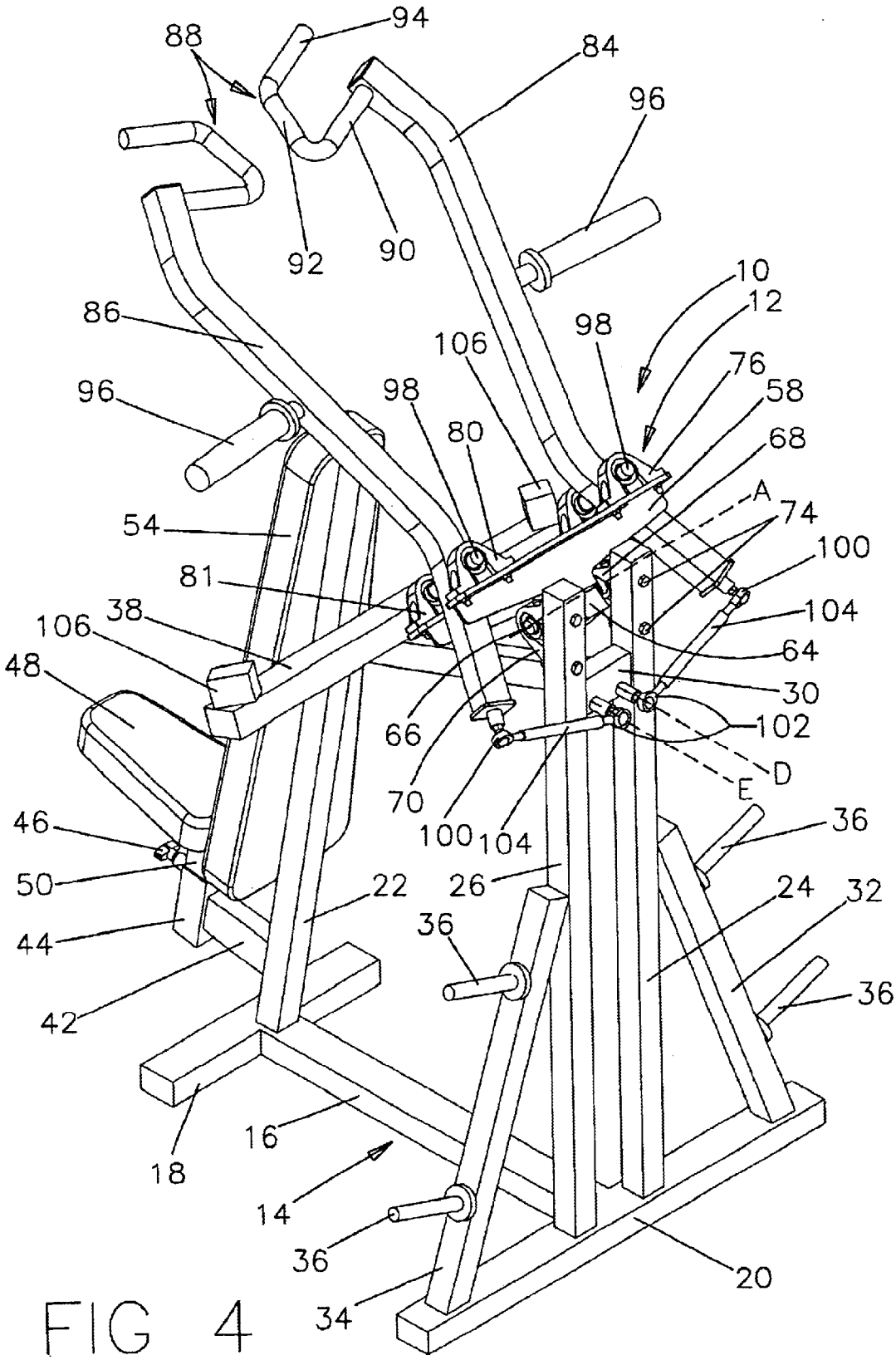
FIG. 4 is a view like FIG. 1 showing the lever arms in an uppermost position.
Figure 5:
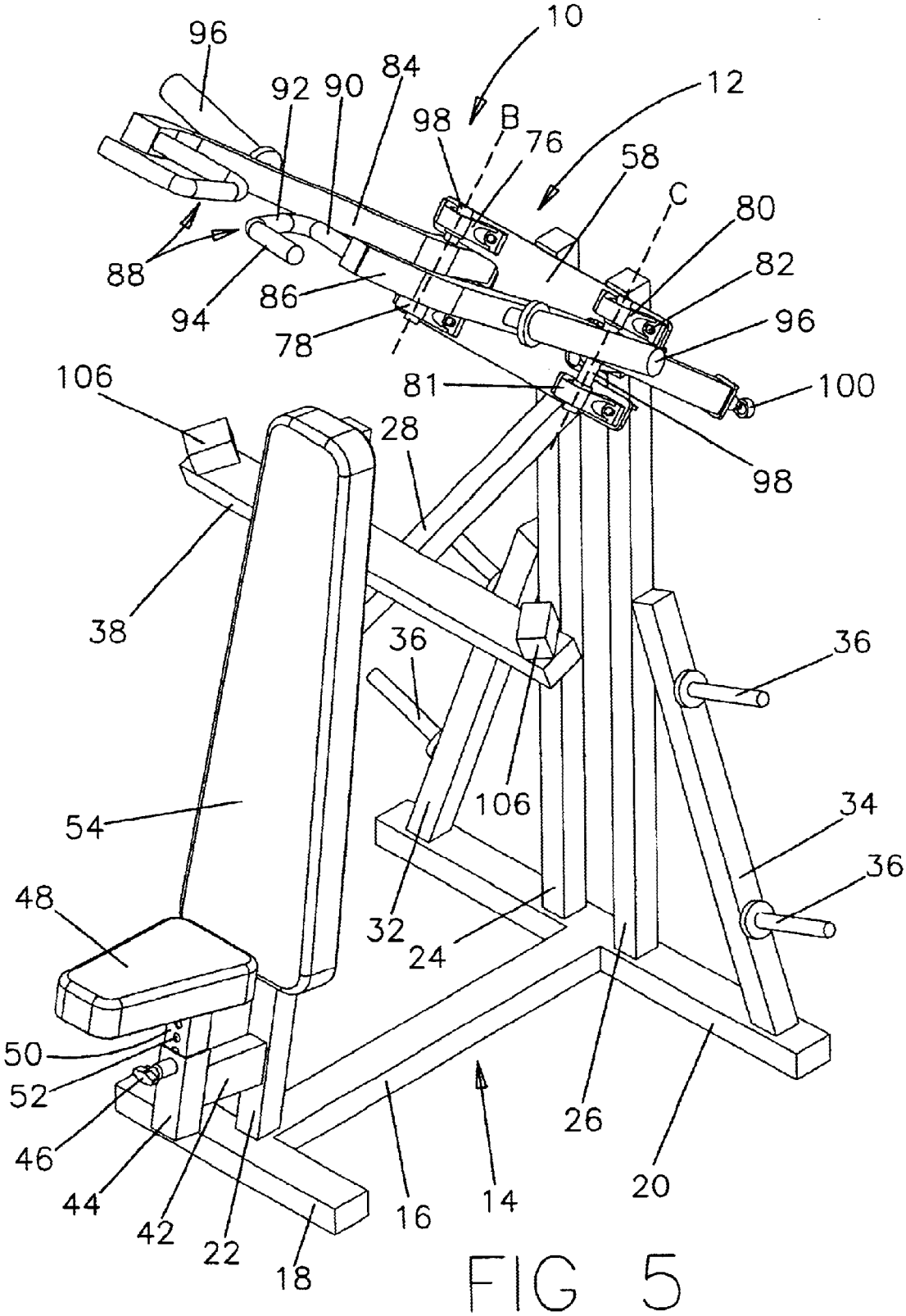
FIG. 5 is a view like FIG. 2 showing the lever arms in the uppermost position.
Figure 6:
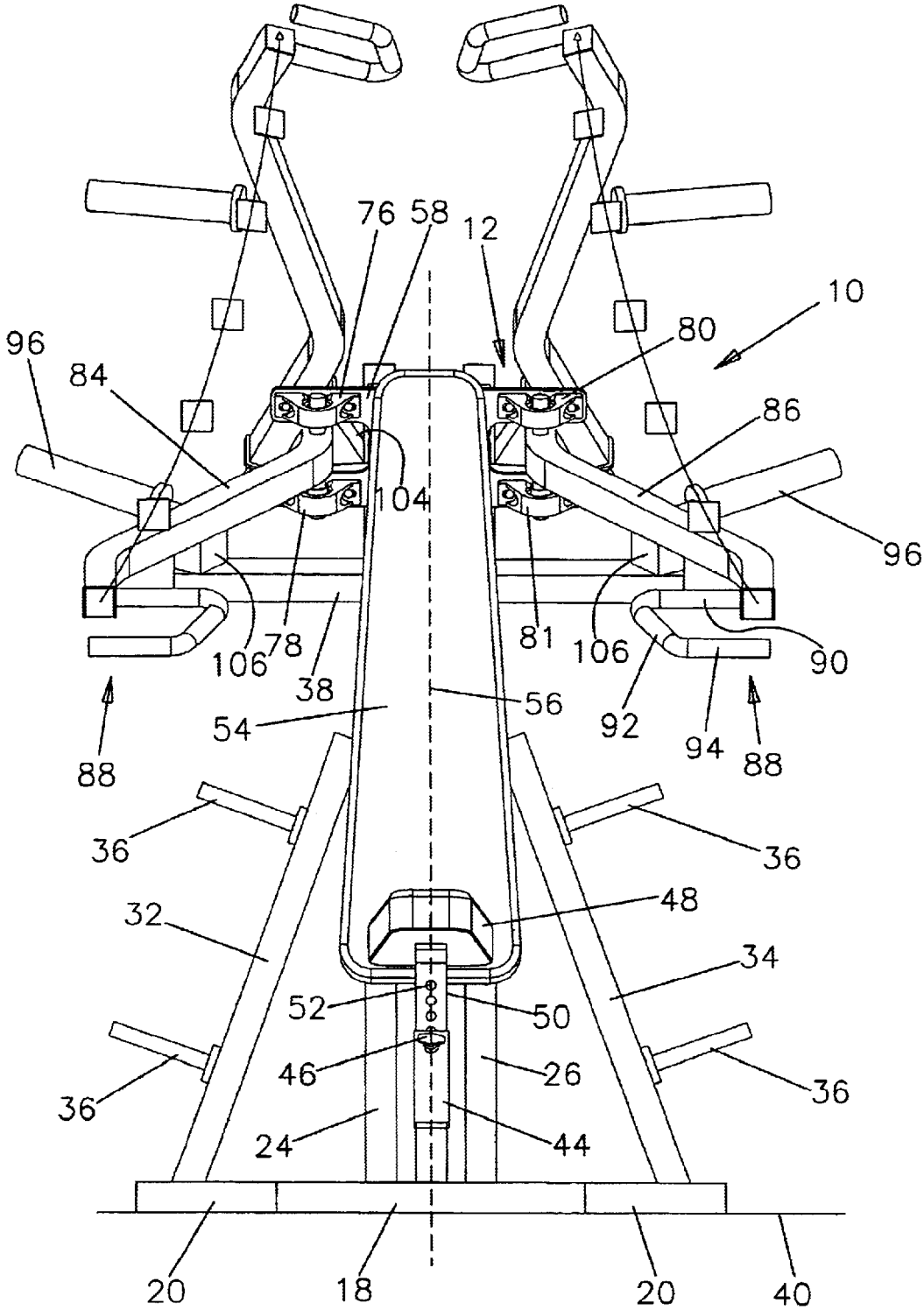
FIG. 6 is a front view of the machine shown in FIG. 1, showing how the lever arms move in concave arcs as they are lifted from the lowermost position to the uppermost position.

In the preferred embodiment the improved and simplified motion translation arrangement 12 takes the form of a rotatable carriage 58 having an upper end 60 and a lower end 62. Extending rearwardly from the center of carriage 58 is a connector block 64 carrying a cylindrical shaft 66 which is pivotable about a horizontal pivot axis A (FIG. 4) coaxial with the longitudinal axis of the shaft 66. The ends of the shaft 66 are pivotally mounted in a pair of spaced left and right hand pillow block bearings 68, 70 which are each vertically affixed to the upper, forward portion of the uprights 24, 26, respectively, by bolts 72 (FIG. 2) and nuts 74 (FIG. 4). By the above described structure, the entire carriage 58 is rotatable about the horizontal pivot axis A.

Figure 3:
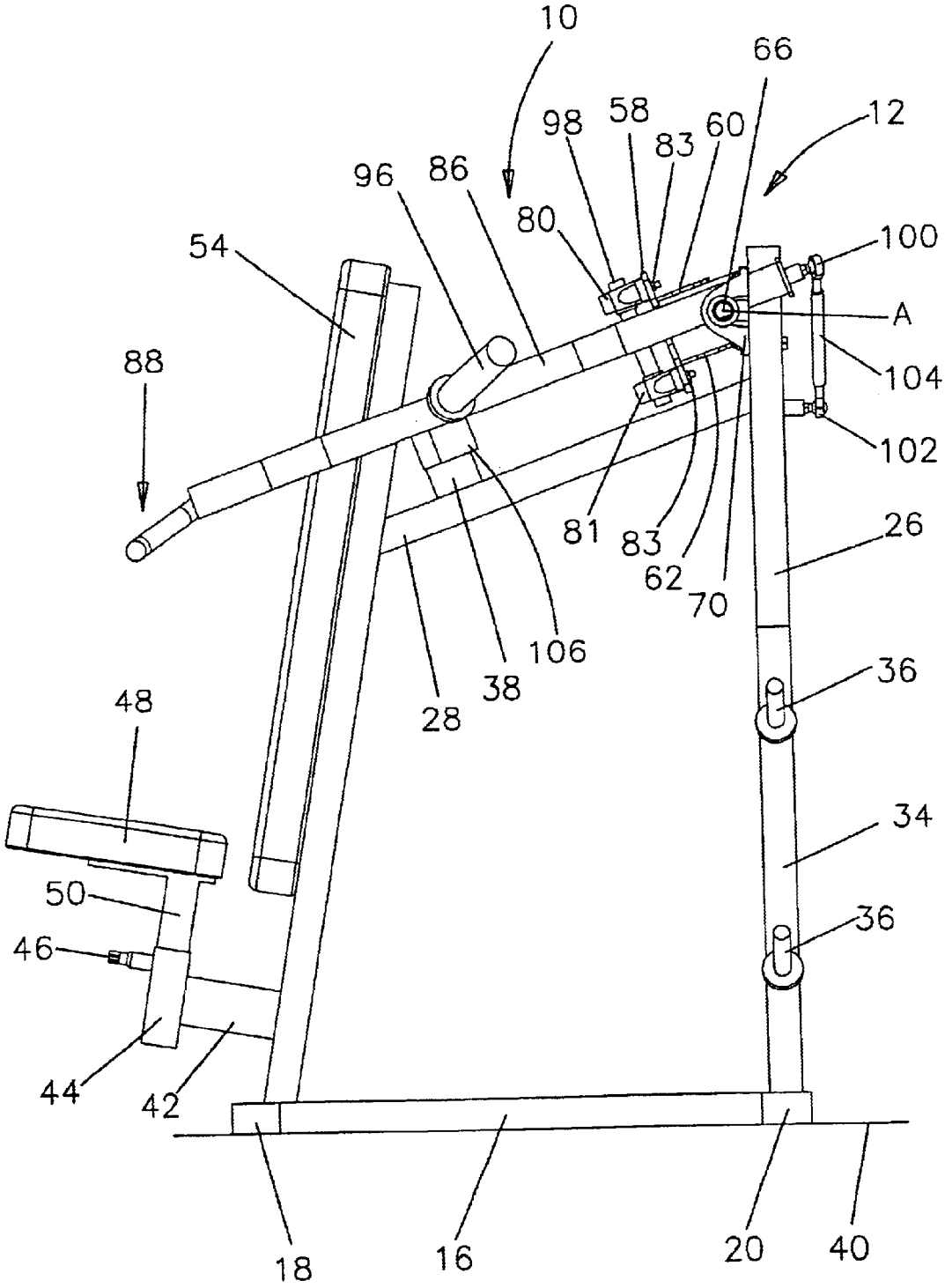
FIG. 3 is a view from the right side of FIG. 1.

Attached to the forward side of the carriage 58 is a left hand set of pillow block bearings 76, 78 (FIG. 5) and a right hand set of pillow block bearings 80, 81 (FIG. 5) which are anchored to the upper and lower ends 60, 62 by nuts 82 (FIG. 5) and bolts 83 (FIG. 3). Each set of pillow block bearings 76, 78 and 80, 81 define the location of a second pair of spaced pivot axes B, C (FIGS. 1, 5) about which a pair of lever arms 84, 86 swing inwardly and outwardly relative to backrest 54. As seen best in FIG. 3, the pivot axes B, C are disposed generally perpendicularly to the longitudinal axis of shaft 66 (i.e. the horizontal pivot axis A) and are variously oriented with respect to a plane passing through the uprights 24, 26. Each lever arm 84, 86 is a curvilinear, nonarticulated member which extends downwardly and diverges outwardly relative to the carriage 58. A forward end of each lever arm 84, 86 includes a rubber covered, bent handle 88 having an inwardly extending portion 90, a downwardly and outwardly extending portion 92 and a horizontally outwardly extending portion 94 with respect to backrest 54. The handles 88 present a natural gripping portion for the hands of an exerciser as they move through inwardly curved concave planes to be explained hereafter. A mid portion of each lever arm 84, 86 is provided with a laterally outwardly and upwardly extending support spindle 96 for holding one or more removable weight plates (not shown) that define a variable resistance against which the lever arms 84, 86 are moved. It should be understood that while the invention preferably depicts removable weight plates, the machine 10 can be modified to include a cable and weight stack system or any other variable resistance commonly used in the art. A rearward portion of each lever arm 84, 86 includes a stub shaft 98, (FIG. 5) having upper and lower ends which are rotatable in pillow block bearings 76, 78, 80, 81 about the pivot axes B, C. A rearward end of each lever arm 84, 86 includes a lever arm knuckle 100 (FIGS. 1, FIG. 4) which provides a swivel joint mounting arrangement. Extending rearwardly and fixed from the cross member 30 joining the uprights 24, 26 is a pair of frame knuckles 102 which define a second pair of parallel, spaced pivot axes D and E (FIGS. 1 and 4). The pivot axes D and E lie transverse to and below the horizontal pivot axis A. A connector link 104 joins each arm knuckle 100 and frame knuckle 102 so that as the lever arms 84, 86 are raised, the rearward ends thereof will rotate about pivot axes D and E from the position shown in FIG. 1 to the position shown in FIG. 4. Together, the knuckles 100, 102 and connector links 104 define transfer linkages for ultimately translating the lever arms 84, 86. Each lever arm 84, 86 preferably has a length of 42 inches and is oriented downwardly in a rest position at an initial angle of about 20 degrees from the horizontal as shown in FIG. 3. In order to limit their downward extent, each arm 84, 86 coacts with a rubber block 106 (FIG. 2) mounted at the ends of angular brace 28.

Figure 7:
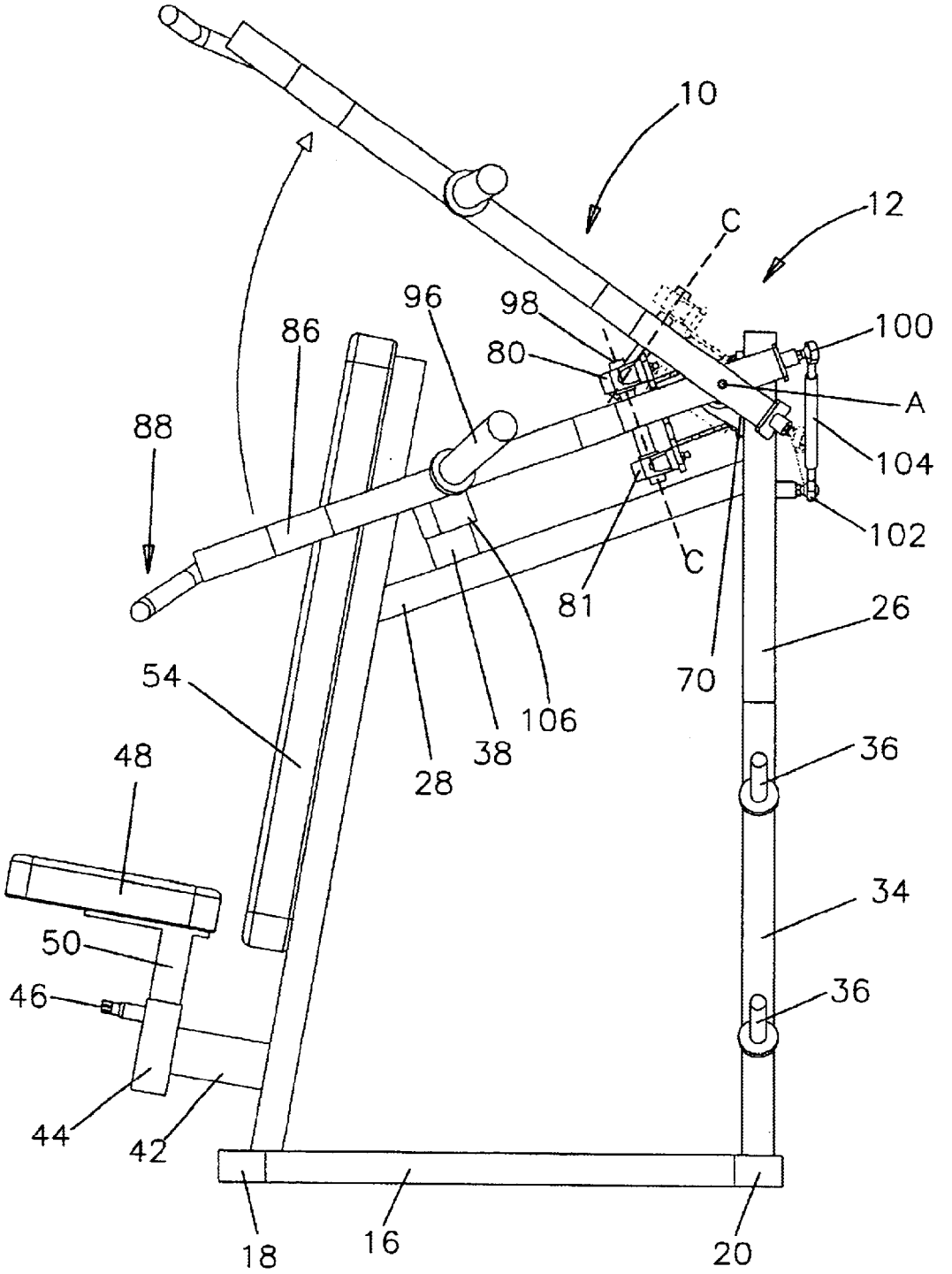
FIG. 7 is a view like FIG. 3 showing the lever arms in their uppermost position.

In use, one or more weight plates are transferred from the weight spindles 36 on gussets 32, 34 to the spindles 96 on lever arms 84, 86. The exerciser adjusts the seat 48 to a suitable position along the support post 50 so the handles 88 lie at the proper vertical height relative to the shoulders. The exerciser then grasps the handles 88 and pushes upwardly causing both lever arms 84, 86 to pivot upwardly from the rest position of FIGS. 1 and 2 about the horizontal pivot axis A (longitudinal axis of shaft 66). As the lever arms 84, 86 continue to move upwardly, they will swing inwardly about pivot axes B, C, the swinging movement being transferred via the arm knuckles 100, the frame knuckles 102 and the connector links 104 to pivot the lever arms 84, 86 about the pivot axes D and E. As a result, the lever arms 84, 86 move in inwardly curved planes shown in FIG. 6 and assume a completed shoulder press movement shown in solid lines of FIG. 4. FIG. 7 shows the lever arms 84, 86 are generally pivoted upwardly about 55 degrees to 35 degrees from horizontal. This of course depends on such functions such as the torso and limb lengths of the exerciser. Here, the handles 88 have not only moved upwardly, rearwardly and inwardly from their spaced initial position on either side of the vertical plane 56 bisecting the machine 10, but they have also rotated slightly inward about 20 degrees or 30 degrees, or in this case supinated, to achieve a high degree of isolated shoulder exercise with maximum accommodation to the exercisers musculoskeletal structure. In contrast to the assignee's prior '701 patent, the motion translation arrangement 12 of the present invention prevents the handles 88 from contacting each other as the uppermost location is approached. Specifically, the motion translation arrangement 12 decreases the rate of convergence as the lever arms 84, 86 are raised to a point of substantially no convergence so that an exerciser with long arms as well as short arms will obtain an optimal range of motion without stress to the shoulders, wrist and elbow joints.

Figure 8:
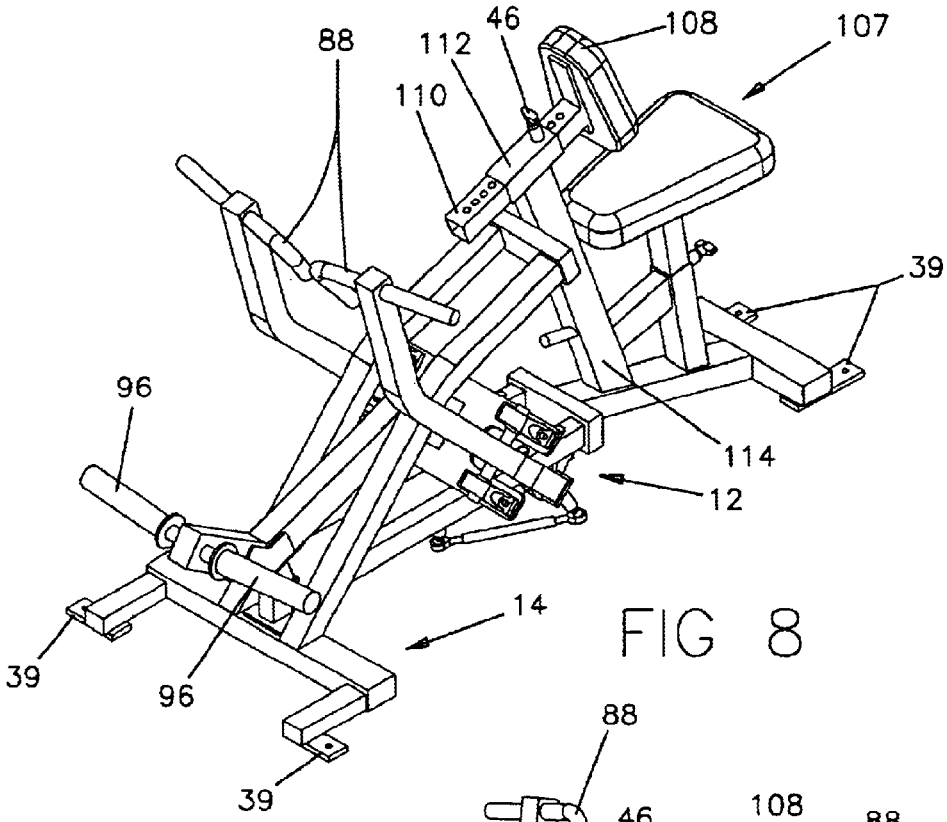
FIG. 8 is a rear perspective view of a low lat pull machine embodying the present invention, the machine being equipped with a pair of lever arms in a lowermost position.
Figure 9:
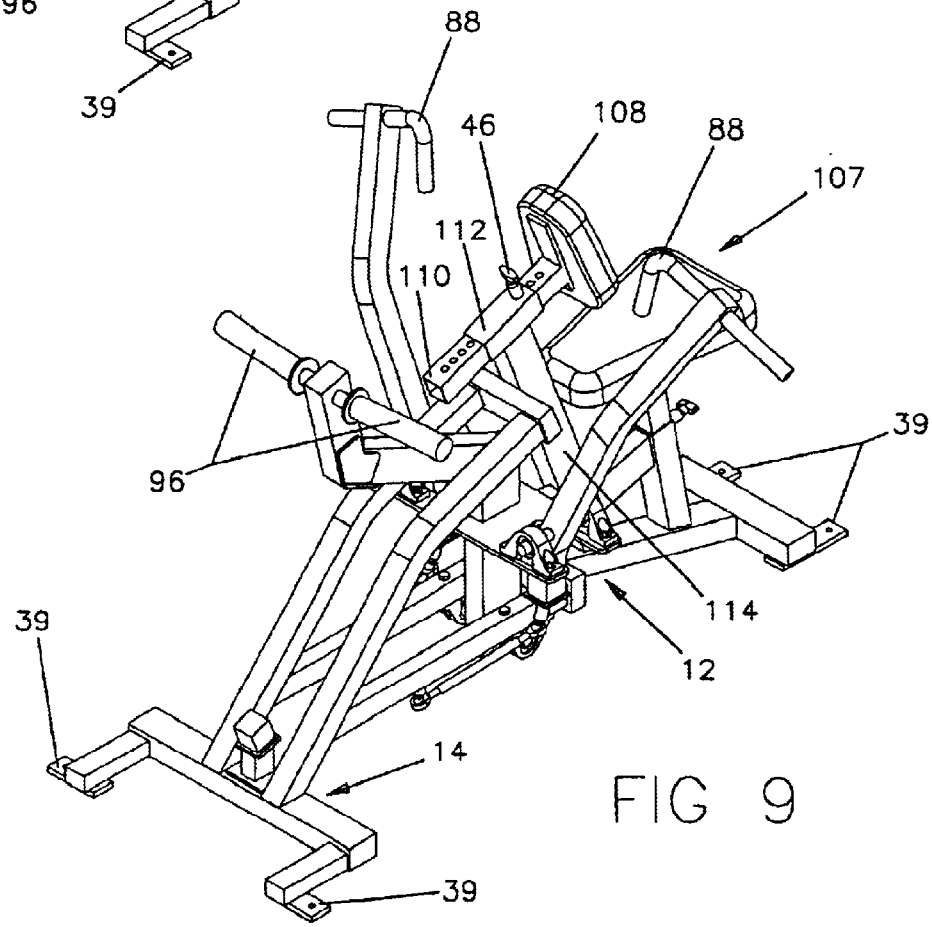
FIG. 9 is a view like FIG. 8 showing the lever arms in an uppermost position.

FIGS. 8 and 9 illustrate the use of a carriage 12' on low lat pull machine 107. Like numerals denote like elements previously discussed so that carriage 12' is similar to carriage 12. A cushion 108 is provided in front of the exerciser's chest for support during the low lat pull. The cushion 108 has a support post 110 which is adjustable in a tubular member 112 connected at the top of angular member 114. A spring or pop in pin selector like selector 46' aligns a pin with a hole formed in the support post 110 to select a desired protection. In the machine, the exerciser loads weight plates (not shown) on spindles 96' and then proceeds to pull handles 88' rearwardly from a closely spaced position on the other side of the cushion 108 at which the handles 88' are slightly rotated or pronated. In other words, the carriage 12' is used to give a reverse effect from the shoulder press application. However, the carriage 12' translates motion in a similar fashion as carriage 12, there being a difference in the lengths of certain components.

It should be understood that the present invention provides a motion translation arrangement for an exercise machine which can effectively exercise the upper torso without subjecting the shoulder joint to undue stress. The present machine provides a more simplified structure then previously disclosed, yet improves upon the range of motion for exercisers of all sizes.

While the invention has been described with reference to a preferred embodiment, those skilled in the art will appreciate that certain substitutions, alterations and omissions may be made without departing from the spirit thereof. For example, if two carriages 58 (each configured to hold one of the lever arms 84, 86) were mounted on two separate main pivot shafts 66 (each with separate pillow block bearings 68, 70) the lever arms 84, 86 could be moved independently. Accordingly, the foregoing description is meant to be exemplary only and should not be deemed limitative on the scope of the invention set forth with the following claims.

Various alternatives and embodiments are contemplated as being within the scope of the following claims particularly pointing out and distinctly claiming the subject matter regarded as the invention.

I claim:

1. A shoulder exercise machine having a variable resistance provided therein, the shoulder comprising:

a frame;

a seat mounted to the frame;

a backrest attached to the frame rearwardly of the seat;

a motion translation arrangement pivotally mounted to the frame about at least one horizontal pivot axis, and defining a first pair of spaced, parallel pivot axes lying perpendicular to the horizontal pivot axis;

a pair of lever arms movable against the variable resistance, the lever arms having rearward portions pivotally connected to the motion translation arrangement about the first pair of pivot axes, rearward ends rotatably mounted about a second pair of pivot axes lying perpendicular to and below the horizontal pivot axis and downwardly extending, outwardly diverging forward ends having inwardly extending handles, and the motion translation arrangement including means to compel the lever arms to converge by pivoting about the first and second pairs of pivot axes as the motion translation arrangement is pivoted about the at least one horizontal pivot axis, the motion translation arrangement constructed and arranged to provide a shoulder exercise motion for an exerciser occupied in the seat wherein the lever arms and handles are moved in inwardly curved, converging planes from a lowermost location to an uppermost location substantially upwardly, rearwardly and inwardly from the lowermost location, the lever arms being moved in such a way that the rate of convergence decreases as the lever arms are raised to a point of substantially no convergence so as to provide an optimal range of motion for exercisers regardless of their arm length.

2. The shoulder exercise machine of claim 1, wherein the variable resistance is a weight plate removably connected to at least one of the lever arms.

3. The shoulder exercise machine of claim 1, wherein each handle also extends downwardly.

4. The shoulder exercise machine of claim 1, wherein the second pair of pivot axes are defined by a pair of machine frame knuckles fixedly connected to a back end of the frame.

5. The shoulder exercise machine of claim 1, wherein the second pair of pivot axes are located below the rearward ends of the lever arms.

6. An exercise machine comprising:

a frame;

a seat adjustably mounted on the frame;

a carriage pivotally mounted to the frame about a horizontal pivot axis, the carriage defining a first pair of spaced, parallel pivot axes lying perpendicular to the horizontal pivot axis;

a pair of curvilinear lever arms, each having one rearward portion pivotally connected to the carriage at one of the first pair of pivot axes, a rearward end rotatably mounted about one of a second pair of pivot axes lying below the horizontal pivot axis and a forward end provided with a handle; and structure for resisting movement of the lever arms, wherein movement of the lever arms and the carriage against the resisting structure and about the horizontal pivot axis will be translated into lateral motion of the lever arms about the first and second pairs of pivot axes such that each of the handles will move in converging, concave arcs from a first location spaced laterally from a vertical plane bisecting the exercise machine to a second location substantially upwardly, rearwardly and inwardly from the first location, the lever arms being moved as such a way that the rate of convergence decreases as the lever arms are raised to a point of substantially no convergence so as to provide an optimal range of motion for exercisers regardless of their arm length.

7. The exercise machine of claim 6, wherein the seat is adapted to support an exerciser in a declined and seated position stradling the vertical plane.

8. The exercise machine of claim 6, wherein each of the lever arms is provided with at least one laterally extending spindle for supporting at least one weight plate.

9. The exercise machine of claim 6, wherein an additional starting position for each lever arm is about 20 degrees from horizontal.

10. The exercise machine of claim 6, wherein the rearward end of each lever arm includes an arm knuckle movably joined by a connector link to a frame knuckle mounted at a back end of the frame.

11. In an exercise machine having a frame, a seat mounted on the frame and a pair of lever arms pivotally mounted relative to the frame, the lever arms having handles mounted thereon, the improvement residing in:

a carriage pivotally mounted to the frame about a horizontal pivot axis, the carriage defining a first pair of spaced parallel pivot axes lying perpendicular to the. horizontal pivot axes, and having transfer linkages, each linkage being swingably connected at one end to one of the lever arms and pivotally connected at another end to the frame about a second pair of pivot axes located below the horizontal pivot axis, wherein movement of the lever arms and carriage about the horizontal pivot axis and the first pair of pivot axes will be translated into lateral motion of the lever arms about the second pair of pivot axes such that each lever arm moves in a concave path from a first location to a second location in such a manner that the handles are prevented from contacting each other as the lever arm approaches the second location.

12. The exercise machine of claim 11, in the form of a shoulder press machine.

13. The exercise machine of claim 11, in the form of a low lat pull machine.

14. The exercise machine of claim 11, wherein each transfer linkage is comprised of an arm knuckle attached to a rearward end of one of the lever arms, a frame knuckle joined to a back end of the frame and a connector link joining the arm knuckle and the frame knuckle.

15. The exercise machine of claim 11, wherein the horizontal pivot axis passes through a shaft rotatably supported in a set of primary pillow block bearings mounted on the frame.

16. The exercise machine of claim 11, wherein each of the first pair of pivot axes passes through a shaft rotatably supported in a set of secondary pillow block bearings mounted on the carriage.

* * * * *